US012446672B2

(12) United States Patent
Zhong

(10) Patent No.: US 12,446,672 B2
(45) Date of Patent: Oct. 21, 2025

(54) HAIR CURLING IRON

(71) Applicant: SHENZHEN GMT-PCBA TECHNOLOGY CO., LTD., Shenzhen (CN)

(72) Inventor: Ren Zhong, Shenzhen (CN)

(73) Assignee: SHENZHEN GMT-PCBA TECHNOLOGY CO., LTD., Shenzhen (CN)

( * ) Notice: Subject to any disclaimer, the term of this patent is extended or adjusted under 35 U.S.C. 154(b) by 240 days.

(21) Appl. No.: 18/488,955

(22) Filed: Oct. 17, 2023

(65) Prior Publication Data

US 2025/0072574 A1 Mar. 6, 2025

(30) Foreign Application Priority Data

Sep. 1, 2023 (CN) ..... 202322402901.0

(51) Int. Cl.
*A45D 2/36* (2006.01)
*A45D 6/20* (2006.01)

(52) U.S. Cl.
CPC ..... *A45D 2/367* (2013.01); *A45D 6/20* (2013.01)

(58) Field of Classification Search
CPC ... A45D 1/10; A45D 1/12; A45D 1/16; A45D 1/28; A45D 2/00; A45D 2/001; A45D 2/02; A45D 2/06; A45D 2/367; A45D 2002/006; A45D 4/12; A45D 6/00; A45D 6/02; A45D 6/04; A45D 20/124
See application file for complete search history.

(56) References Cited

U.S. PATENT DOCUMENTS

2012/0240955 A1* 9/2012 Kennedy ..... A45D 1/28 132/229
2024/0049854 A1* 2/2024 Kennedy ..... A45D 1/10
2024/0415258 A1* 12/2024 Fu ..... A45D 1/28

* cited by examiner

*Primary Examiner* — Rachel R Steitz
*Assistant Examiner* — Karim Asqiriba
(74) *Attorney, Agent, or Firm* — Li & Cai Intellectual Property Office

(57) ABSTRACT

A hair curling iron relating to the field of hairdressing devices is provided, which includes a handle and a hair curling component having a plurality of specifications and detachably connected to the handle. The handle includes a housing, a driving component disposed in the housing, and a rotating component of which one end rotates in the housing. A working end of the driving component is connected to the rotating component, one end of the hair curling component adjacent to the handle is provided with a connecting post and a plurality of probes. The connecting post is detachably inserted into another end of the rotating component, and the plurality of probes are correspondingly connected to a circuit in the handle through the rotating component.

9 Claims, 3 Drawing Sheets

HAIR CURLING IRON

FIELD OF THE DISCLOSURE

The present disclosure relates to the technical field of hairdressing devices, and more particularly to a hair curling iron.

BACKGROUND OF THE DISCLOSURE

A hair curling iron is a small hand-held appliance used to curl hair. The existing hair curling iron generally consists of a handle and a curling component arranged at the front end of the handle. The hair curling component includes a heating rod that can generate heat and a hair clip that matches the outer arc surface of the heating rod. When in use, the user puts the hair in the hair clip and wraps the hair around the heating iron for hair curling.

The existing hair curling components are divided into multiple specifications and sizes due to different sizes of heating rods, which can match different curvatures of perms and are often used to create different types of curls. Some existing curling irons are equipped with a driving motor in the handle to drive the curling component to automatically rotate for automatic hair curling. For some curling irons, curling components of different sizes can be disassembled and replaced, allowing users to choose to create different types of curls. However, there is a lack of a curling iron that can automatically curl hair and curling components of different specifications that can be disassembled and replaced.

SUMMARY OF THE DISCLOSURE

The purpose of the present disclosure is to provide a hair curling iron that can automatically curl hair and be able to disassemble and replace hair curling components of different specifications.

In order to solve the above-mentioned problems, the present disclosure provides a hair curling iron, which includes: a handle and a hair curling component having a plurality of specifications and detachably connected to the handle. The handle includes a housing, a driving component disposed in the housing, and a rotating component of which one end rotates in the housing. A working end of the driving component is connected to the rotating component, one end of the hair curling component adjacent to the handle is provided with a connecting post and a plurality of probes, the connecting post is detachably inserted into another end of the rotating component, and the plurality of probes are correspondingly connected to a circuit in the handle through the rotating component.

Preferably, the hair curling iron further includes a mounting seat. The mounting seat is abutted against and accommodated in the housing, the working end of the driving component penetrates the mounting seat and is connected to the rotating component. One side of the mounting seat facing the hair curling component is provided with an accommodating groove, and two layers of conductive rings in rotational contact with each other are provided in the accommodating groove. A plurality of connecting sheets provided on one layer of conductive ring penetrate the mounting seat and are electrically connected to the circuit in the handle, and a plurality of connecting sheets on another layer of conductive ring are electrically connected to the rotating component.

Preferably, the rotating component includes a rotating base, a connecting circuit board and a connecting member. The rotating base and the connecting circuit board are stacked on the one side of the mounting seat facing the hair curling component, the working end of the driving component is connected to the rotating base, the plurality of connecting sheets on the another layer of conductive ring penetrate the rotating base and are electrically connected to the connecting circuit board, one side of the rotating base facing the hair curling iron is provided with a plurality of mounting posts so as to be connected to the connecting members. A plurality of pogo pins are provided on the connecting circuit board, and another end of each of the plurality of pogo pins is inserted into the connecting member.

Preferably, one end of the connecting member is sleeved outside each of the plurality of mounting posts and rotatably accommodated in the housing, and another end of the connecting member is provided with a mounting groove. A plurality of through posts are provided on a groove bottom of the mounting groove, another end of each of the plurality of pogo pins passes through and is accommodated in a corresponding one of the plurality of through posts, so as to dock with a corresponding one of the plurality of probes. Openings are provided between each of the plurality of through posts to be sleeved on the connecting post, and a locking member is further provided in the accommodating groove to elastically lock the connecting post.

Preferably, one end of the locking member is elastically abutted against a circumferential inner wall of the mounting groove through an elastic member, and another end of the locking member penetrates a groove wall of the mounting groove. A disassembly key is provided on the another end of the locking member. The locking member is configured to move in a direction of compressing the elastic member by pressing the disassembly key, a middle part of the locking member is sleeved outside each of the plurality of through posts, a movement space is provided in a stretching direction of the elastic member, and a protruding part is provided in a side of the middle of the locking member facing the key to press against the connecting post.

Preferably, the rotating component further includes a plug-in head. One end of the plug-in head is arranged in the mounting groove of the connecting member, and holes are provided to positions on the plug-in head corresponding to the plurality of through posts and the openings to facilitate penetration connections of the connecting post and each of the plurality of probes.

Preferably, the rotating component further includes a fastener sleeved outside each of the plurality of mounting posts and located between the connecting member and the connecting circuit board, and the fastener is rotatably connected to a circumferential inner wall of the housing.

Preferably, the hair curling iron further includes a main control circuit board disposed in the housing. Positions of the main control circuit board corresponding to penetrations through the housing are provided with a regulating key and a display screen to facilitate a user to control the hair curling iron.

Preferably, the hair curling iron further includes a light strip. The light strip includes a light guide ring, the light guide ring is sleeved on an open end of the housing, and a protrusion is provided on an outer edge of the light guide ring and configured to support the hair curling iron placed on a desktop to achieve a supporting function through a structural feature of the protrusion. An annular circuit board is provided in the light guide ring, a plurality of LED lamp beads are arranged on the annular circuit board in a ring shape, and one side of the annular circuit board is electrically connected to a control circuit board. A light blocker is further provided on the one side of the mounting seat, the light blocker is sleeved on the working end of the driving component, a slit is provided on one side of the light blocker, a photoelectric switch is provided at a position of the control circuit board corresponding to the light blocker, the control circuit board is provided with a regulating button and a control key at positions where the control circuit board penetrates the housing, and one side of the control circuit board is further electrically connected to a toggle switch.

Preferably, a plurality of slots correspondingly matching the driving component, the mounting seat and the rotating component are provided on a circumferential inner wall of the housing for assembly.

Compared with the beneficial effects of the conventional technology, the hair curling iron of the present disclosure includes the handle and the curling component having the plurality of specifications and detachably connected to the handle. Preferably, sizes of a heating rod in the hair curling component are 10 mm, 16 mm, 22 mm, 28 mm and 38 mm, the handle includes a housing, one end of the housing is provided with an accommodating cavity, the driving component is arranged in the housing, and one end of the rotating component is rotated and accommodated in the open end of the housing. Preferably, the driving component is a driving motor, and the working end of the driving motor is connected to the rotating component to drive the rotating component to rotate. The one end of the hair curling component adjacent to the handle is provided with the connecting post, and the connecting post can be detachably inserted into the another end of the rotating component away from the housing, so that the rotating component can drive the hair curling component to rotate to achieve automatic hair curling. The detachable setting of the connecting post can also facilitate a replacement of the hair curling component having different specifications, so as to improve the applicability of the hair curling rod. The plurality of probes are further provided on the one end of the hair curling component adjacent to the handle, and the plurality of probes are correspondingly connected to the circuit in the handle through the rotating component, thereby enabling the connection of the circuit after the replacement of the hair curling component. The probe may include a temperature detection probe and a power supply probe for a heating core. The heating core is provided in the heating rod. Preferably, two power supply probes for the heating core are provided, and are used to supply power to the heating core. Preferably, two temperature detection probes are further provided, and are used to connect a NTC tied to the heating core to implement temperature detection and transmit corresponding detection data so that the handle can control the temperature state of the hair curling component. For example, the hair curling iron is maintained at a predetermined temperature and so on.

Figure 1:
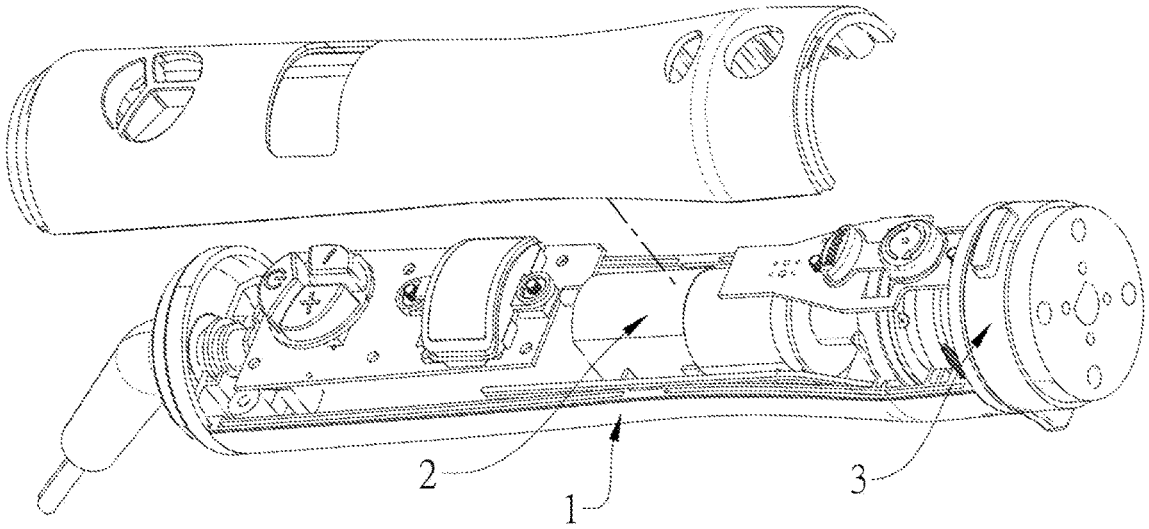
FIG. 1 is a schematic exploded diagram of a handle according to an embodiment of the present disclosure.

Reference numeral: 1, housing; 2, driving component; 3, rotating component; 4, connecting post; 5, probe; 6, main control circuit board; 7, display screen; 8, regulating key; 9, control circuit board; 10, regulating button; 11, control key; 12, toggle switch; 31, mounting seat; 32, conductive ring; 33, rotating base; 34, connecting circuit board; 35, mounting post; 36, pogo pin; 37, fastener; 38, light strip; 39, annular circuit board; 310, connecting member; 311, locking member; 312, plug-in head; 3101, through post; 3102, opening; 3111, protruding part; 3112, elastic member; 3113, disassembly key.

DETAILED DESCRIPTION OF THE EXEMPLARY EMBODIMENTS

In order to make the above objects, features and advantages of the present disclosure more obvious and easy to understand, specific embodiments of the present disclosure will be described in detail below with reference to the accompanying drawings.

It should be noted that the terms "first" and "second" in the specification and claims of the present disclosure and the above drawings are used to distinguish similar objects, but not necessarily used to describe a specific order or sequence. It is to be understood that the data so used are interchangeable under appropriate circumstances such that the embodiments of the present disclosure described herein can be practiced in sequences other than those illustrated or described herein.

In the description of the present disclosure 1, it should be noted that, unless otherwise expressly stipulated and limited, the terms "set", "installation", "connected" and "connecting" should be understood in a broad sense. For example, it can be a fixed connection, a detachable connection, or an integral connection; it can be a mechanical connection; it can be a direct connection, or it can be an indirect connection through an intermediate medium, or it can be an internal connection between two components. Those of ordinary skill in the art can understand the specific meanings of the above terms in the present disclosure in specific situations.

In the description of this specification, reference to the terms "embodiment," "one embodiment," and "one implementation," etc., means that a specific feature, structure, material, or characteristic described in connection with the example or implementation is included in at least one embodiment or embodiment of the present disclosure. In this specification, the schematic representations of the above terms do not necessarily refer to the same embodiment or implementation. Furthermore, the specific features, structures, materials or characteristics described may be combined in any suitable manner in any one or more embodiments or implementations.

The present disclosure will be described in detail below in conjunction with the accompanying drawings.

Figure 2:
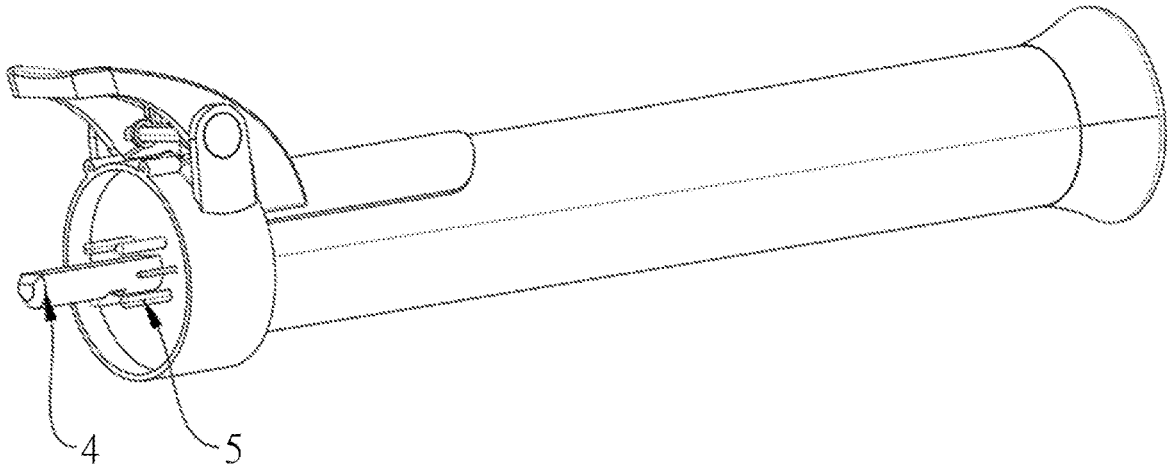
FIG. 2 is a schematic structural diagram of a hair curling component according to the embodiment of the present disclosure.

In order to solve the above technical problems, which is to be read in conjunction with FIG. 1 and FIG. 2, an embodiment of the present disclosure provides a hair curling iron, which includes a handle and a hair curling component having a plurality of specifications and detachably connected to the handle. The handle includes a housing 1, a driving component 2 disposed in the housing 1, and a rotating component 3 of which one end rotates in the housing 1. A working end of the driving component 2 is connected to the rotating component 3, one end of the hair curling component adjacent to the handle is provided with a connecting post 4 and a plurality of probes 5, the connecting post 4 is detachably inserted into another end of the rotating component 3, and the plurality of probes 5 are correspondingly connected to a circuit in the handle through the rotating component 3.

It should be noted that the hair curling iron includes the handle and the curling component having the plurality of specifications and detachably connected to the handle. Preferably, a size of a heating rod in the hair curling component is 10 mm, 16 mm, 22 mm, 28 mm and 38 mm, the handle includes the housing 1, one end of the housing 1 is provided with an accommodating cavity, the driving component 2 is arranged in the housing 1, and one end of the rotating component 3 is rotatably accommodated in the open end of the housing. Optionally, the driving component 2 is a driving motor, the working end of the driving motor is connected to the rotating component 3 to drive the rotating component 3 to rotate, and the one end of the hair curling component adjacent to the handle is provided with the connecting post 4. The connecting post 4 is detachably inserted on the another end of the rotating component 3 away from the housing 1, so that the rotating component 3 can drive the hair curling component to rotate to realize automatic hair curling. The detachable setting of the connecting post 4 can also facilitate replacement of the hair curling component of different specifications so as to improve the applicability of the hair curling rod. The plurality of probes 5 are further arranged on the one end of the hair curling component adjacent to the handle. The plurality of probes 5 are correspondingly connected to the circuit in the handle through the rotating component 3, thereby enabling the connection of the circuit after the replacement of the hair curling component. The probe 5 may include a temperature detection probe and a power supply probe for a heating core, and the heating rod is provided with a heating core. Preferably, two power supply probes for the heating core are provided, and are used to supply power to the heating core. Preferably, two temperature detection probes are provided, and are used to connect a NTC tied to the heating core to implement temperature detection and transmit corresponding detection data, so that the handle can control the temperature state of the hair curling component. For example, the hair curling iron is maintained at a predetermined temperature and so on.

Figure 3:
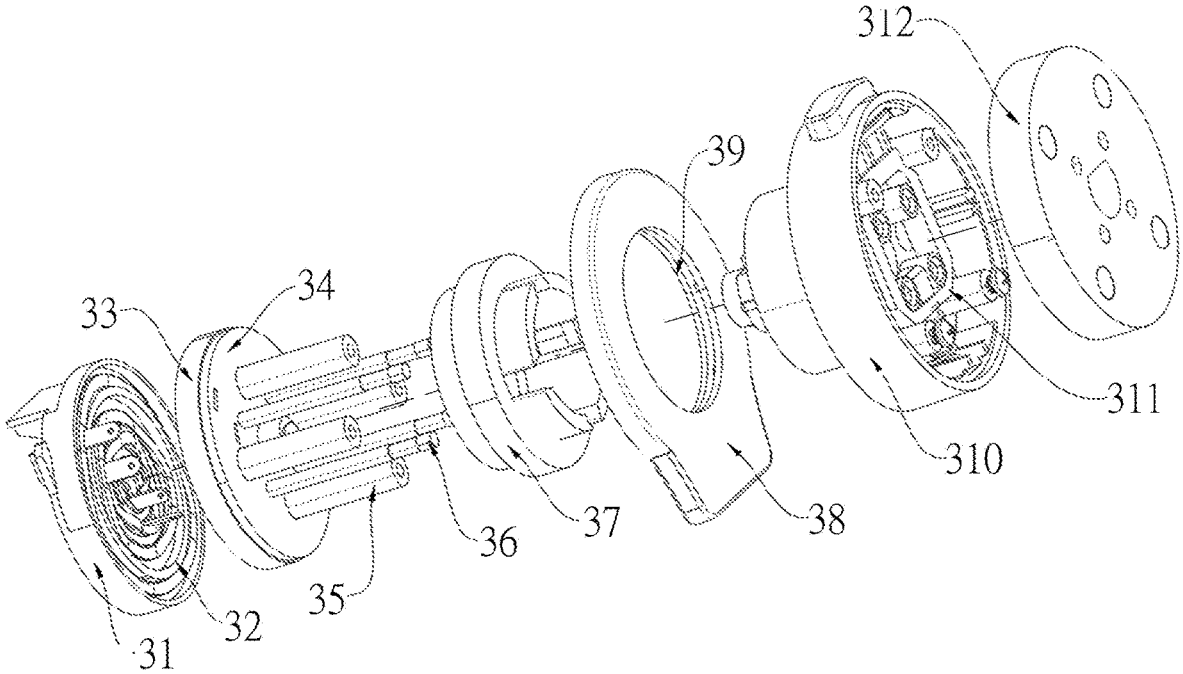
FIG. 3 is a schematic exploded diagram of a rotating component according to the embodiment of the present disclosure.

In one embodiment of the present disclosure, which is to be read in conjunction with FIG. 3, the hair curling iron further includes a mounting seat 31 abutted against and accommodated in the housing 1, and the working end of the driving component 2 penetrates the mounting seat 31. The mounting seat 31 is connected to the rotating component 3, one side of the mounting seat 31 facing the hair curling component is provided with an accommodating groove, and the accommodating groove is provided with two layers of conductive rings 32 in rotational contact with each other. A plurality of connecting sheets provided on one layer of conductive ring 32 penetrate the mounting seat 31 and are electrically connected to the circuit in the handle, and a plurality of connecting sheets on another layer of conductive ring 32 are electrically connected to the rotating component 3.

It should be noted that, optionally, the mounting seat 31 is disk-shaped, a circumferential outer wall of the mounting seat 31 is abutted against and disposed in the housing 1, and the working end of the driving component 2 penetrates the mounting seat 31 and is connected to the rotating component 3. The one side of the mounting seat 31 facing the hair curling component is provided with the accommodating groove. The accommodating groove is provided with the two layers of conductive rings 32 in rotational contact with each other. The conductive rings 32 are in spiral ring structures. One layer of conductive ring 32 is fitted and disposed in the accommodation groove to serve as a first conductive ring, and another layer of conductive ring 32 serves as a second conductive ring. A part of the second conductive ring protrudes in a direction toward the first conductive ring, so as to be in abutting contact with the first conductive ring, so that when the second conductive ring rotates, an electrical connection with the first conductive ring can be maintained. A plurality of connecting sheets on the first conductive ring penetrate the mounting seat 31 and are electrically connected to the circuit in the handle through wires, and a plurality of connecting sheets on the second conductive ring are electrically connected to the rotating component 3, so that the rotating component 3 can maintain power supply to the circuit on one side of the hair curling component when rotating, and can solve the problem that the wires in the handle will twist when the rotating component 3 rotates.

In one embodiment of the present disclosure, which is to read in conjunction with FIG. 3, the rotating component 3 includes a rotating base 33, a connecting circuit board 34 and a connecting member 310. The rotating base 33 and the connecting circuit board 34 are stacked on one side of the mounting base 31 facing the hair curling component, the working end of the driving component 2 is connected to the rotating base 33, and the plurality of connecting sheets on the another layer of conductive ring 32 penetrate the rotating base 33 and are electrically connected to the connecting circuit board 34. A plurality of mounting posts 35 are provided on one side of the rotating base 33 facing the hair curling iron to be connected to the connecting member 310. A plurality of pogo pins 36 are provided on the connecting circuit board 34 and another end of each of the plurality of pogo pins 36 is inserted into the connecting member 310.

It should be noted that the rotating base 33 and the connecting circuit board 34 are stacked, and then are fixed through each connecting sheet of the second conductive ring. In addition, soldering legs of the connecting sheets are welded to the connecting circuit board 34 so as to be electrically connected to the connecting circuit board 34. The working end of the driving component 2 is connected to the rotating base 33 to drive the rotating base 33 to rotate. The one side of the rotating base 33 facing the hair curling iron is provided with the plurality of mounting posts 35, and the connecting member 310 is provided with mounting slots matching the mounting posts 35, so as to be sleeved on an end of each of the mounting posts 35 away from the rotating base 33 to be driven to rotate. The connecting circuit board 34 is provided with the plurality of pogo pins 36, and one end of each of the plurality of pogo pins 36 is electrically connected to the conductive ring through the circuit on the connecting circuit board 34, the another end of each of the plurality of pogo pins 36 is inserted into the connecting member 310, and the connecting post 4 of the hair curling component is inserted in the connecting member 310, so as to be driven to rotate. Each of the plurality of probes 5 is inserted in the connecting member 310 and respectively docked with each of the plurality of pogo pins 36 to enable circuit communication, and each of the plurality of pogo pins 36 is elastic and can be respectively and stably connected to each of the plurality of probes 5.

Figure 4:
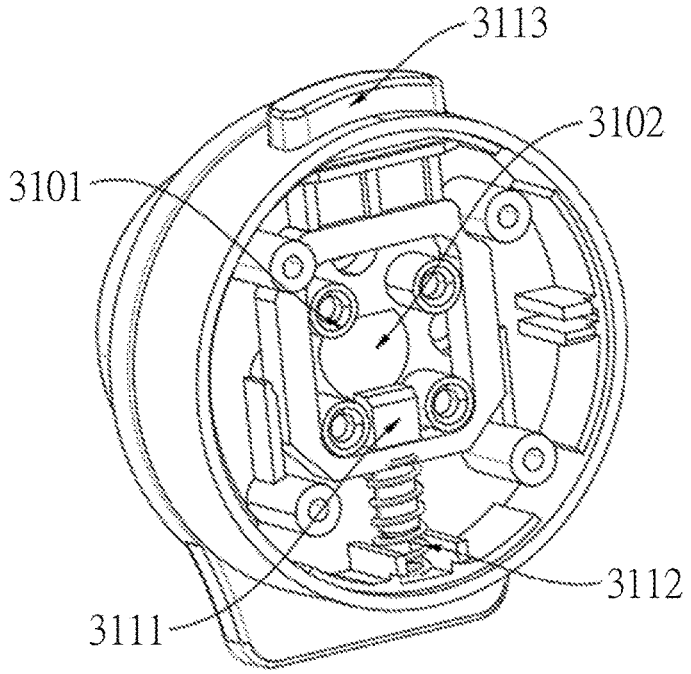
FIG. 4 is a schematic structural diagram of a connecting member and a locking member according to the embodiment of the present disclosure.

In one embodiment of the present disclosure, which is to be read in conjunction with FIG. 3 and FIG. 4, the one end of the connecting member 310 is sleeved outside each of the plurality of mounting posts 35 and is rotatably accommodated in the housing 1. Another end of the connecting member 310 is provided with a mounting groove, a plurality of through posts 3101 are arranged on the groove bottom of the mounting groove, and the another end of each of the plurality of pogo pins 36 passes through and is accommodated in a corresponding one of the plurality of through posts 3101, so as to dock with a corresponding one of the plurality of probes 5. An opening 3102 is provided between each of the plurality of through posts 3101 to be sleeved on the connecting post 4, and a locking member 311 is further provided in the accommodating groove for elastically locking the connecting post 4.

It should be noted that the one end of the connecting member 310 is sleeved outside of each of the mounting posts 35 and is rotatably accommodated in the housing 1, and the another end of the connecting member 310 is provided with a mounting groove. The groove bottom of the mounting groove is provided with the plurality of through posts 3101 spatially connecting with accommodating parts. One end of each pogo pin 36 away from the connecting circuit board 34 penetrates and is accommodated in each of the through posts 3101. When the hair curling component is assembled, each of the probes 5 is inserted into the through post 3101 so as to be electrically connected to each of the pogo pins 36. The openings 3102 are further provided between the through posts 3101 on the groove bottom of the mounting groove to be sleeved on the connecting post 4, and the locking member 311 is further provided to facilitate locking and releasing the connecting post 4 to coordinate the assembly and replacement of the hair curling component.

In one embodiment of the present disclosure, which is to be read in conjunction with FIGS. 3 and 4, one end of the locking member 311 is elastically abutted against a circumferential inner wall of the mounting groove through an elastic member 3112. Another end of the locking member 311 penetrates a wall of the mounting groove, and is provided with a disassembly key 3113. By pressing the disassembly key 3113, the locking member 311 can move in the direction of compressing the elastic member 3112. The middle part of the locking member 311 is sleeved outside each of the through posts 3101, and has a movement space in a stretching direction of the elastic member 3112. A protruding part 3111 is provided in a side of the middle of the locking member 311 facing the button to press against the connecting post 4.

It should be noted that the one end of the locking member 311 is extended with a post structure, and the elastic member 3112 can be a spring. One end of the spring is sleeved on the post structure, and another end of the spring is abutted against the circumferential inner wall of the mounting groove. Preferably, another end of the locking member 311 opposite to the post structure penetrates the groove wall of the mounting groove, the disassembly key 3113 is arranged thereon, and the middle part of the locking member 311 is sleeved on each of the through posts 3101. The protruding part 3111 is provided in the side of the middle of the locking member 311 facing the key. When the connecting post 4 is inserted into the opening 3102, the spring supports the protruding part 3111 to press against the groove of the connecting post 4, so as to fix the connecting post 4 and realize the assembly of the hair curling component. The middle part of the locking member 311 has the movement space in the stretching direction of the elastic member 3112, so that when disassembling, by pressing the disassembly key 3113 to compress the spring, the locking member 311 moves downward, so that the protruding part 3111 releases the connecting post 4, thereby realizing the disassembly of the hair curling component. An arrangement of a fastener 37 can make the assembly of the hair curling component stable and ensure that the hair curling component can rotate.

In one embodiment of the present disclosure, which is to be read in conjunction with FIG. 3, the rotating component 3 further includes a plug-in head 312. One end of the plug-in head 312 is disposed in the mounting groove of the connecting member 310. And the plug-in head 312 is provided with holes at positions corresponding to the through posts 3101 and the openings 3102 to facilitate insertion of the connecting post 4 and each of the probes 5.

It should be noted that the one end of the plug-in head 312 is disposed in the mounting groove of the connecting member 310, and another end of the plug-in head 312 away from the connecting member 310 is provided with the holes at positions corresponding to the through posts 3101 and the openings 3102 to facilitate the insertion of the connecting post 4 and each of the probes 5. The plug-in head 312 can cooperate with the connecting member 310, so that the connecting member 310 is correspondingly and stably connected to the connecting post 4 and each of the probes 5.

In one embodiment of the present disclosure, which is to be read in conjunction with FIG. 3, the rotating component 3 further includes the fastener 37 sleeved outside of each of the mounting post 35 and located between the connecting member 310 and the connecting circuit board 34. An outer circumference of the fastener 37 is in rotational contact with the circumferential inner wall of the housing 1.

It should be noted that, when rotating, the mounting post 35 is rotated outwards, and when it is transferred to the hair curling component, an offset of the hair curling component will become larger, which will affect the use. Therefore, it is necessary to arrange the fastener 37 outside the mounting post 35. The fastener 37 includes a fastening ring sleeved outside the mounting post 35 and a bearing sleeved outside the fastening ring. The bearing is abutted against the circumferential inner wall of the housing 1 and plays a supporting and fixing role, so that the fastening ring can rotate along with each of the mounting posts 35, and the fastening ring can provide support for each of the mounting posts 35. The mounting post 35 provides a pressing force toward a center, so as to prevent a rotation deviation of each of the mounting posts 35 and make the rotation of the hair curling component more stable, which is convenient for a user to use.

Figure 5:
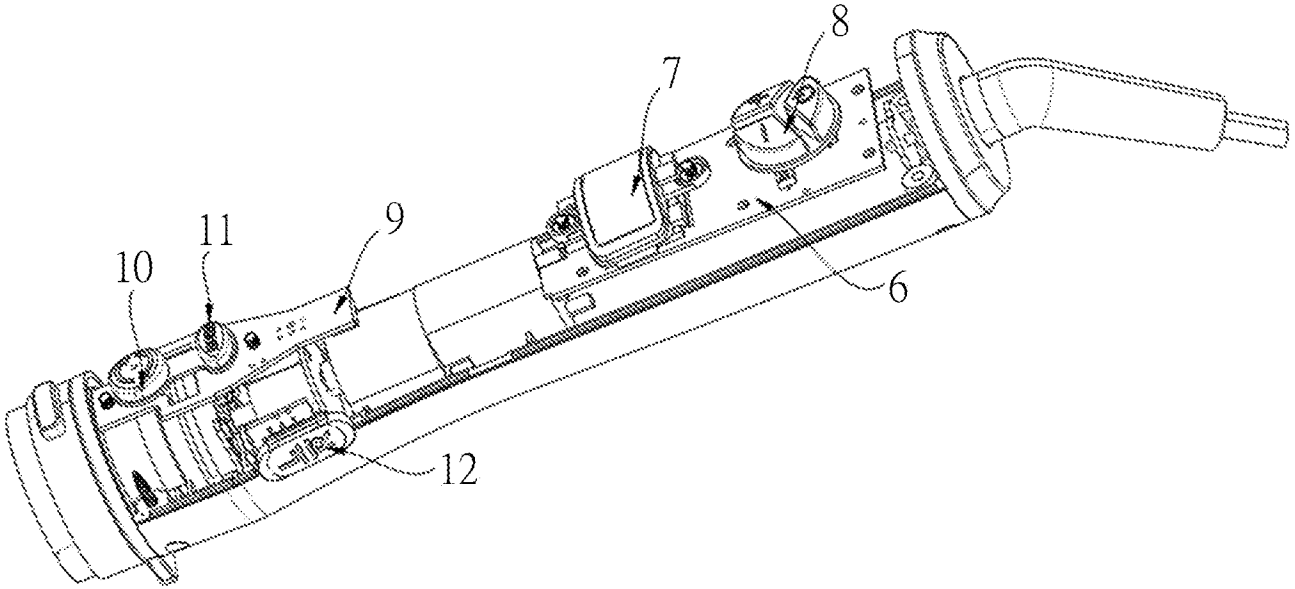
FIG. 5 is a partial schematic structural diagram of the handle according to the embodiment of the present disclosure.

In one embodiment of the present disclosure, which is to be read in conjunction with FIG. 5, a main control circuit board 6 is further provided. The main control circuit board 6 is disposed in the housing 1. The housing 1 is provided with a regulating key 8 and a display screen 7 at positions correspondingly penetrating the housing 1 to facilitate the user to control the hair curling iron.

It should be noted that the main control circuit board 6 is disposed in the housing 1 and is located on one side of the driving component 2 away from the rotating component 3. The regulating key 8 and the display screen 7 are disposed on the housing 1 and connected to the main control circuit board 6. The main control circuit board 6 is connected to a commercial power through a connecting wire at a tail of the housing 1. In addition, the main control circuit board 6 is electrically connected to each connecting member of the first conductive ring through a wire, so as to be electrically connected to the hair curling component. The main control circuit board 6 is electrically connected to the driving component 2.

In one embodiment of the present disclosure, which is to be read in conjunction with FIG. 3 and FIG. 5, the hair curling iron further includes a light strip. The light strip includes a light guide ring 38, the light guide ring 38 is sleeved on an open end of the housing 1, and a protrusion is provided on an outer edge of the light guide ring 38 and configured to support the hair curling iron placed on a desktop. An annular circuit board 39 is provided in the light guide ring 38, a plurality of LED lamp beads are arranged on the annular circuit board 39 in a ring shape, and one side of the annular circuit board 39 is electrically connected to a control circuit board 9. A light blocker is further provided on the one side of the mounting seat 31, and the light blocker is sleeved on the working end of the driving component 2. A slit is provided on one side of the light blocker, a photoelectric switch is provided at a position of the control circuit board corresponding to the light blocker, the control circuit board 9 is provided with a regulating button 10 and a control key 11 at a position where the control circuit board 9 penetrates the housing 1, and one side of the control circuit board 9 is further electrically connected to a toggle switch 12.

It should be noted that the light guide ring 38 is placed on the open end of the housing 1, that is, the end adjacent to the connector 310. Preferably, the light guide ring 38 is a matte light guide ring made of a PC material, and a protruding part is extended on a side of the light guide ring 38. Preferably, a bottom edge of the protruding part is horizontally arranged, so that it is convenient to support and place the hair curling iron on the desktop to prevent rolling. The annular circuit board 39 is arranged in the light guide ring 38, and the annular circuit board 39 is arranged on a side of the light guide ring 38 adjacent to the driving component 2. The annular circuit board 39 is arranged with the plurality of LED lamp beads arranged at intervals in a ring. Preferably, the LED lamp beads can be phantom LED lamp beads capable of cyclically flashing different colors. The control circuit board 9 is horizontally arranged on a top of the ring circuit board 39, and the regulating button 10 and the control key 11 are arranged on the housing 1 and electrically connected to the control circuit board 9, so as to regulate a returning state of the hair curling iron. One side of the mounting base 31 adjacent to the driving component 2 is further provided with the light blocker, the light blocker is sleeved on the working end of the driving component 2. One side of the light blocker is provided with a slit, and the photoelectric switch is arranged at the position corresponding to the light blocker on the control circuit board 9. A light of the photoelectric switch can pass through the position of the slit, which is set as a handheld convenient position of the hair curling component. Therefore, when the light blocker and the hair curling component rotate synchronously and the hair curling component is not in the handheld convenient position, by pressing the regulating button 10, the driving component 2 can drive the light blocker and the hair curling component to rotate together until the light of the photoelectric switch passes through the slit, then the rotation stops, the hair curling component returns to the handheld convenient position. It is convenient for users to use the product. The one side of the control circuit board 9 is also electrically connected to the toggle switch 12 to control the working end of the driving component 2 to rotate left and right to achieve left and right curling. The control circuit board 9 is connected to the connecting circuit board 34 through a FFC connection cable, so that power is supplied to the light strip through the annular circuit board 39.

In one embodiment of the present disclosure, which is to be read in conjunction with FIGS. 1 and 3, the circumferential inner wall of the housing 1 is provided with a plurality of slots correspondingly matching the driving component 2, the mounting seat 31 and the rotating component 3 for assembly.

It should be noted that the plurality of slots are provided on the circumferential inner wall of the housing 1, and the slots are arranged around the circumferential inner wall of the housing 1 to correspondingly adapt to the driving component 2, the mounting seat 31 and the rotating component 3, so that the driving component 2 and the mounting base 31 are correspondingly fixed and the rotating component 3 is rotatably accommodated, which facilitates assembly and makes an internal structure more stable and prevents loosening.

It should be noted that the above-mentioned technical features continue to be combined with each other to form various embodiments not listed above, which are all regarded as the scope of the description of the present disclosure. Moreover, those skilled in the art can make improvements or transformations according to the above description, and all these improvements and transformations should belong to the protection scope of the appended claims of the present disclosure.

What is claimed is:

1. A hair curling iron, comprising: a handle and a hair curling component having a plurality of components and detachably connected to the handle, wherein the handle includes a housing (1), a driving component (2) disposed in the housing (1), and a rotating component (3) of which one end rotates in the housing (1); a working end of the driving component (2) is connected to the rotating component (3), one end of the hair curling component adjacent to the handle is provided with a connecting post (4) and a plurality of probes (5), the connecting post (4) is detachably inserted into another end of the rotating component (3), and the plurality of probes (5) are correspondingly connected to a circuit in the handle through the rotating component (3);

further comprising a mounting seat (31), wherein the mounting seat (31) is abutted against and accommodated in the housing (1), the working end of the driving component (2) penetrates the mounting seat (31) and is connected to the rotating component (3), one side of the mounting seat (31) facing the hair curling component is provided with an accommodating groove, two layers of conductive rings (32) in rotational contact with each other are provided in the accommodating groove; wherein a plurality of connecting sheets provided on one layer of conductive ring (32) penetrate the mounting seat (31) and are electrically connected to the circuit in the handle, and another plurality of connecting sheets on another layer of conductive ring (32) are electrically connected to the rotating component (3).

2. The hair curling iron according to claim 1, wherein the rotating component (3) includes a rotating base (33), a connecting circuit board (34) and a connecting member (310); the rotating base (33) and the connecting circuit board (34) are stacked on the one side of the mounting seat (31) facing the hair curling component, the working end of the driving component (2) is connected to the rotating base (33), the another plurality of connecting sheets on the another layer of the conductive ring (32) penetrate the rotating base (33) and are electrically connected to the connecting circuit board (34), one side of the rotating base (33) facing the hair curling iron is provided with a plurality of mounting posts (35) so as to be connected to the connecting members (310), a plurality of pogo pins (36) are provided on the connecting circuit board (34), and another end of each of the plurality of pogo pins (36) is inserted into the connecting member (310).

3. The hair curling iron according to claim 2, wherein one end of the connecting member (310) is sleeved outside each of the plurality of mounting posts (35) and rotatably accommodated in the housing (1), another end of the connecting member (310) is provided with a mounting groove, a plurality of through posts (3101) are provided on a groove bottom of the mounting groove, the another end of each of the plurality of pogo pins (36) passes through and is accommodated in a corresponding one of the plurality of through posts (3101), so as to dock with a corresponding one of the plurality of probes (5), openings (3102) are provided between each of the plurality of through posts (3101) to be sleeved on the connecting post (4), and a locking member (311) is further provided in the accommodating groove to elastically lock the connecting post (4).

4. The hair curling iron according to claim 3, wherein one end of the locking member (311) is elastically abutted against a circumferential inner wall of the mounting groove through an elastic member (3112), another end of the locking member (311) penetrates a groove wall of the mounting groove with a disassembly key (3113) provided thereon; the locking member (311) is configured to move in a direction of compressing the elastic member (3112) by pressing the disassembly key (3113), a middle part of the locking member (311) is sleeved outside each of the plurality of through posts (3101), a movement space is provided in a stretching direction of the elastic member (3112), and a protruding part (3111) is provided in a side of the middle of the locking member (311) facing the disassembly key (3113) to press against the connecting post (4).

5. The hair curling iron according to claim 4, wherein the rotating component (3) further includes a plug-in head (312), one end of the plug-in head (312) is arranged in the mounting groove of the connecting member (310), and holes are provided to positions on the plug-in head (312) corresponding to the plurality of through posts (3101) and the openings (3102) to facilitate penetration connections of the connecting post (4) and each of the plurality of probes (5).

6. The hair curling iron according to claim 3, further comprising a light strip, wherein the light strip includes a light guide ring (38), the light guide ring (38) is sleeved on an open end of the housing (1), a protrusion is provided on an outer edge of the light guide ring (38) and configured to support the hair curling iron placed on a desktop to achieve a supporting function through a structural feature of the protrusion; an annular circuit board (39) is provided in the light guide ring (38), a plurality of LED lamp beads are arranged on the annular circuit board (39) in a ring shape, one side of the annular circuit board (39) is electrically connected to a control circuit board (9), a light blocker is further provided on the one side of the mounting seat (31), the light blocker is sleeved on the working end of the driving component (2), a slit is provided on one side of the light blocker, a photoelectric switch is provided at a position of the control circuit board (9) corresponding to the light blocker, the control circuit board (9) is provided with a regulating button (10) and a control key (11) at positions where the control circuit board (9) penetrates the housing (1), and one side of the control circuit board (9) is further electrically connected to a toggle switch (12).

7. The hair curling iron according to claim 2, wherein the rotating component (3) further includes a fastener (37) sleeved outside each of the plurality of mounting posts (35) and located between the connecting member (310) and the connecting circuit board (34), and the fastener (37) is rotatably connected to a circumferential inner wall of the housing (1).

8. The hair curling iron according to claim 1, further comprising a main control circuit board (6) disposed in the housing (1), wherein positions of the main control circuit board (6) corresponding to penetrations through the housing (1) are correspondingly provided with a regulating key (8) and a display screen (7) to facilitate a user to control the hair curling iron.

9. The hair curling iron according to claim 1, wherein a plurality of slots correspondingly matching the driving component (2), the mounting seat (31), and the rotating component (3) are provided on a circumferential inner wall of the housing (1) for assembly.

* * * * *